US005660105A

United States Patent [19]

Benson et al.

[11] Patent Number: 5,660,105

[45] Date of Patent: Aug. 26, 1997

[54] PUNCHING/EMBOSSING TOOL FOR SHEET MATERIALS

[76] Inventors: Janyce S. Benson, 3540 W. Sahara #204, Las Vegas, Nev. 89102; Michele M. Wagner, 3945 E. Rawhide, Las Vegas, Nev. 89120

[21] Appl. No.: 609,351

[22] Filed: Mar. 1, 1996

[51] Int. Cl.[6] ..... B31F 1/07

[52] U.S. Cl. ..... 101/3.1; 101/31.1

[58] Field of Search ..... 101/18, 3.1, 31.1

[56] References Cited

U.S. PATENT DOCUMENTS

| | | | |
|---|---|---|---|
| 622,987 | 4/1899 | Wagner | 101/31.1 |
| 1,780,715 | 11/1930 | Olson et al. | 101/3.1 |
| 2,005,340 | 6/1935 | Jaffin et al. | 101/31.1 |
| 2,906,197 | 9/1959 | Priesmeyer | 101/28 |
| 3,260,192 | 7/1966 | Ostenberg | 101/3 |
| 4,574,693 | 3/1986 | Fink et al. | 101/3 SP |
| 5,181,464 | 1/1993 | Kuhlman et al. | 101/28 |

FOREIGN PATENT DOCUMENTS

| | | | |
|---|---|---|---|
| 261641 | 5/1968 | Austria | 101/3.1 |

*Primary Examiner*—Edgar S. Burr
*Assistant Examiner*—Daniel J. Colilla
*Attorney, Agent, or Firm*—Joseph N. Breaux

[57] ABSTRACT

A punching/embossing tool for sheet materials including at least one matched punch/die set having octagonally shaped magnetically attractable bases and a pressing mechanism including a first and second pivotally connected compression member. Each of the compression members has a punch/die receiving cavity having a retaining magnet having at least four planar magnetic surfaces oriented with respect to each other in a manner to allow four of the eight planar base sidewalls to be placed in sidewise contact with the at least four planar magnetic surfaces of the retaining magnet.

12 Claims, 2 Drawing Sheets

PUNCHING/EMBOSSING TOOL FOR SHEET MATERIALS

TECHNICAL FIELD

The present invention relates to hand operated punching/embossing tools and more particularly to a hand held punching/embossing tool having interchangeable die/punch sets that are orientable in a variety of directions with respect to the punching/embossing tool.

BACKGROUND ART

Hand operated punching/embossing tools generally include a pressing mechanism that is used to compress a sheet of material between a die/punch set to deform or cut out a section of the sheet material into a desired pattern. The sheet material is generally held between a pair of compression members, each holding a punch or a die, while the compression members are forced together with the pressing mechanism. Although this process is satisfactory, it is often difficult to position the die and punch in the desired location, with respect to a section of sheet material such as paper, with the pattern to be punched or embossed oriented in the desired direction with respect to the sheet material. It would be desirable, therefore, to have a hand operated punching/embossing tool that had included a punch/die set that could be oriented in a variety of user selectable directions with respect to the hand operated punching/embossing tool. In addition, it would also be desirable to have a hand operated punching/embossing tool that included a gauge mechanism for allowing a user to gauge the position of the pattern to be embossed or punched out with respect to an edge of the sheet material. This would allow a user punching or embossing a number of sheets to place the punched or embossed pattern in a uniform position on each sheet.

GENERAL SUMMARY DISCUSSION OF INVENTION

It is thus an object of the invention to provide a hand operated punching/embossing tool that has a punch/die set that can be oriented in a variety of user selectable directions with respect to the hand operated punching/embossing tool.

It is a further object of the invention to provide a hand operated punching/embossing tool that includes a gauge mechanism for allowing a user to gauge the position of the design to be embossed or punched out with respect to an edge of the sheet material.

It is a still further object of the invention to provide a hand operated punching/embossing tool that accomplishes both of the above objects in combination.

Accordingly, a punching/embossing tool for sheet materials is provided. The punching/embossing tool comprises at least one matched punch/die set including a punch member and a die member, each punch member having a punch base constructed from a metal that is magnetically attractable and that is formed into the shape of an octagon cylinder having eight planar punch base sidewalls and being of a first diameter, a first slot insertion member having an octagonal cylinder shape having eight planar first slot insertion member sidewalls and being of a second diameter less than the first diameter, said first slot insertion member being coaxially aligned with and secured to the punch base at first end of the first slot insertion member, and a punch protrusion extending from a second end of the slot insertion member, each die member having a die base constructed from a metal that is magnetically attractable and that is formed into the shape of an octagon cylinder having eight planar die base sidewalls and being of a third diameter, a second slot insertion member having an octagonal cylinder shape having eight planar second slot insertion member sidewalls and being of a fourth diameter less than the third diameter, said second slot insertion member being coaxially aligned with and secured to the die base at a third end of the second slot insertion member, and a die cavity extending into a fourth end of the slot insertion member that corresponds to the punch protrusion in a manner such that the punch protrusion is mateable with the die cavity; and a pressing mechanism including a first and second pivotally connected compression member, the first compression member including a punch receiving cavity accessible through a punch opening formed within a first outer housing, the first outer housing having a first receiving slot formed therein that is open at a first housing end thereof to the punch opening and having a width to engageably receive therein the first slot member, and a first retaining magnet having at least four planar first magnetic surfaces oriented with respect to each other in a manner to allow four of the eight planar punch base sidewalls to be placed in sidewise contact with the at least four planar first magnetic surfaces, the first retaining magnet being disposed within the punch receiving cavity in a manner to allow the first slot insertion member to be disposed within the first receiving slot while four of the eight planar punch base sidewalls are in sidewise contact with the at least four planar first magnetic surfaces, the second compression member including a die receiving cavity accessible through a die opening formed within a second outer housing, the second outer housing having a second receiving slot that is open at a second housing end thereof to the die opening and having a width to engageably receive therein the second slot member, and a second retaining magnet having at least four planar second magnetic surfaces oriented with respect to each other in a manner to allow four of the eight planar die base sidewalls to be placed in sidewise contact with the at least four planar second magnetic surfaces, the second retaining magnet being disposed within the die receiving cavity in a manner to allow the second slot insertion member to be disposed within the second receiving slot while four of the eight planar die base sidewalls are in sidewise contact with the at least four planar second magnetic surfaces, said first and second receiving slots being position in a manner such that said punch protrusion and said die cavity are mated when said first and second compression members are pivoted into a first position, the first slot insertion member is disposed within the first receiving slot while four of the eight planar punch base sidewalls are in sidewise contact with the at least four planar first magnetic surfaces, and the second slot insertion member is disposed within the second receiving slot while four of the eight planar die base sidewalls are in sidewise contact with the at least four planar second magnetic surfaces. The term "engageably received" is used herein to mean the slot insertion member are slidable within the receiving slot but are prevented from rotating more than one-hundred-eighty (1800) degrees while inserted within the receiving slot by contact between at least one slot insertion member sidewall and an edge of the receiving slot.

Preferably, one of the first and second compression members includes a swing out gauging mechanism such as a ruler, and more preferably further includes a second gauging member formed on or connected to the compression member having the swing out gauge and oriented with respect to the swing out gauge in a manner such that the swing out gauge may be swung to a position at a right angle with respect to the first gauging member.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
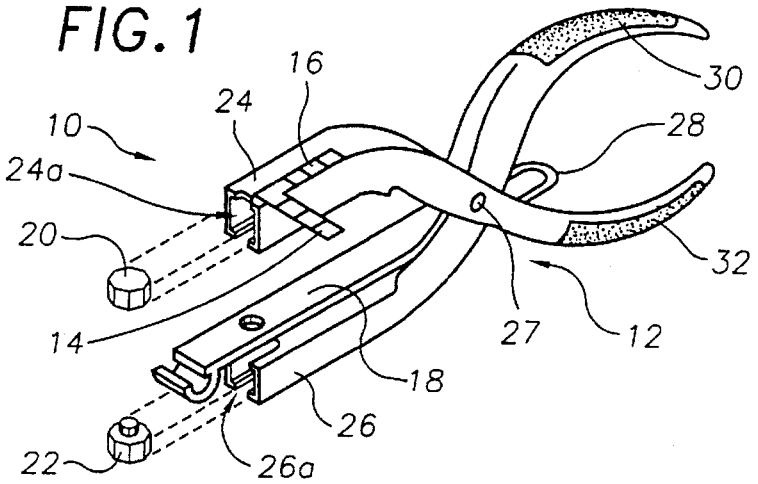
FIG. 1 is a perspective view of an exemplary embodiment of the punching/embossing tool of the present invention showing an exemplary punch/die set exploded away from the die and punch compression members and the swing out ruler of a preferred gauge mechanism.

FIG. 1 is a perspective view of an exemplary embodiment of the punching/embossing tool of the present invention generally designated by the numeral 10. Punching/embossing tool 10 includes a scissor type pressing mechanism, generally designated by the numeral 12, a swing out ruler 14, a stationary ruler 16, a paper holder 18 and a punch/die set that includes a punch member 20 and die member 22. Pressing mechanism 12 includes first and second pivotally connected compression members 24,26. First and second compression members 24,26 are pivotally connected scissor style by a rivet 27 and have two handle portions 30,32 that are biased together by a conventional biasing spring 28.

Each compression member 24,26 has an identical punch/die receiving cavity 24*a*,26*a*, respectively, that will receive therein either a punch 20 or a die 22. First compression member 24 includes a four inch long, stationary ruler 16 adhesively secured to the top surface thereof. Swing out ruler 14 is attached at a forward end of stationary ruler with a rivet to allow swing out ruler 14 to pivot out to a position with respect to stationary ruler 16 of ninety (90°) degrees.

Figure 2:
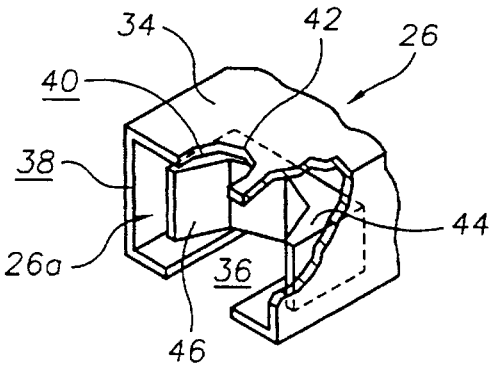
FIG. 2 is a partial cut-away, perspective view of the end of the die compression member showing the half/octagonal sidewalls of the die/punch retaining magnet.

FIG. 2 is a detail, partial cut-away, perspective view of a distal end 34 of second compression member 26 showing punch/die receiving cavity 26*a*. Although the following discussion is made with particular reference to second compression member 26, the description is equally applicable to first compression member 24.

Second compression member 26 includes a first outer housing 34 constructed from metal that has been bent into an open ended, rectangular cross-section, tubular configuration to form a substantially rectangular punch/die receiving cavity 26*a* that is accessible through a punch/die opening 38. Only second compression member 26 includes a punch debris cutout 36. Punch debris cutout 36 is provided to provide a discharge path for punched out sheet material after punching has occurred. A receiving slot 40 is formed through outer housing 34 that is open at a first end thereof to punch/die opening 38. Receiving slot 40 is about one (1") inch wide. The second end of receiving slot 40 has a half octagonal profile 42.

A retaining magnet 44 having four adjacent planar magnetic surfaces 46 oriented in a half octagonal profile at one-hundred-thirty-five (135°) degrees with respect to each adjacent surface is adhesively secured within punch/die receiving cavity 26*a*.

Figure 3:
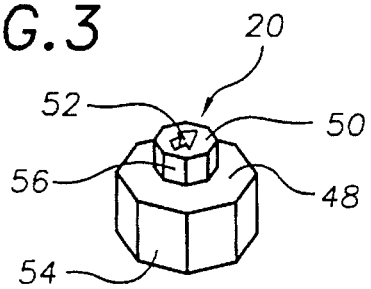
FIG. 3 is a perspective view of an exemplary punch showing the octagonal base portion.

With respect to FIG. 3, punch member 20 includes an integrally formed punch base 48, first slot insertion member 50 and punch protrusion 52. Punch member 20 is constructed from a magnetically attractable steel. Punch base 48 is octagonal cylinder shaped and has eight planar punch base sidewalls 54 that correspond to the planar magnetic surfaces 46 of retainer magnet 44. First slot insertion member 50 is also an octagonal cylinder shape and has eight planar slot insertion member sidewalls 56 that correspond to the half octagonal profile of second end 42 of receiving slot 40. Punch protrusion 52 extends outwardly from a substantially planar top surface of slot insertion member 50. In this embodiment punch protrusion 52 is formed in the shape of an arrow.

Figure 4:
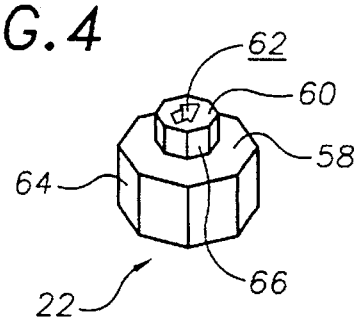
FIG. 4 is a perspective view of an exemplary die showing the octagonal base portion.

With respect to FIG. 4, die member 22 includes an integrally formed die base 58, second slot insertion member 60 and die cavity 62. Die member 22 is constructed from a magnetically attractable steel. Die base 58 is octagonal cylinder shaped and has eight planar die base sidewalls 64 that correspond to the planar magnetic surfaces 46 of retainer magnet 44. Second slot insertion member 60 is also an octagonal cylinder shape and has eight planar slot insertion member sidewalls 66 that correspond to the half octagonal profile of second end 42 of receiving slot 40. Die cavity 62 is arrow shaped and sized to receive therein punch protrusion 52. Die cavity 62 extends entirely through slot insertion member 60 and die base member 58. This allows punched out sections of sheet material to pass entirely through die member 22 and prevents clogging of die member 22 through use.

Figure 5:
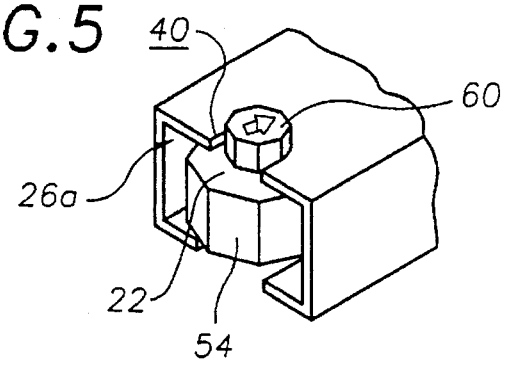
FIG. 5 is a perspective, detail view of the die disposed within the end of the die compression member with the die pattern oriented in a first direction with respect to the punching/embossing tool.
Figure 6:
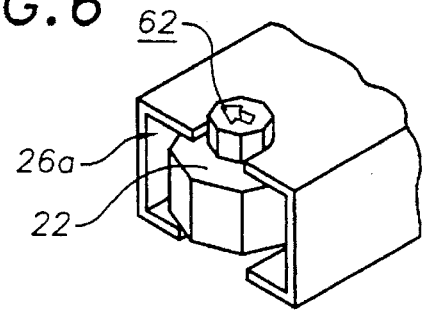
FIG. 6 is a perspective, detail view of the die disposed within the end of the die compression member with the die pattern oriented in a second direction with respect to the punching/embossing tool.

With respect to FIG. 5, die member 22 is shown inserted into punch die receiving cavity 26*a* with four of the planar sidewalls 54 in contact with the magnetic surfaces 46 of retaining magnet 44 (FIG. 2). The magnetic attraction between retaining magnet 44 and die base 58 hold die member 22 securely in place. Retaining magnet is placed with respect to receiving slot 40 in a manner such that second slot insertion member 60 is engageably received within receiving slot 40 when die base sidewalls 64 are in contact with magnetic surfaces 46. FIG. 6 shows die member 22 installed within punch/die receiving cavity 26*a* with die cavity 62 oriented in a second of eight user selectable directions.

Use of hand help punch/embossing tool 10 is now described with general reference to FIGS. 1–6. A desired punch/die set is selected and punch member 20 and die members 22 positioned within punch/die receiving cavities 24*a*,26*a*, respectively, with punch protrusion 52 and die cavity 62 oriented in the same direction. The magnetic attraction of each retaining magnet 44 retains punch and die members 20,22 in contact with retaining magnet 44. A sheet of sheet material, such as paper, is then placed between the first and second compression members 24,26 and handle portions 30 and 32 urged toward one another. This action causes first and second compression members 24 to travel toward one another and causes punch protrusion 52 to enter die cavity 62 punching out a section of the sheet material. If it is desired to reorient the direction of punch protrusion 52 and die cavity 62 it is a simple matter to slide punch and die members 20,22 out and reinsert them in the desired orientation.

Figure 7:
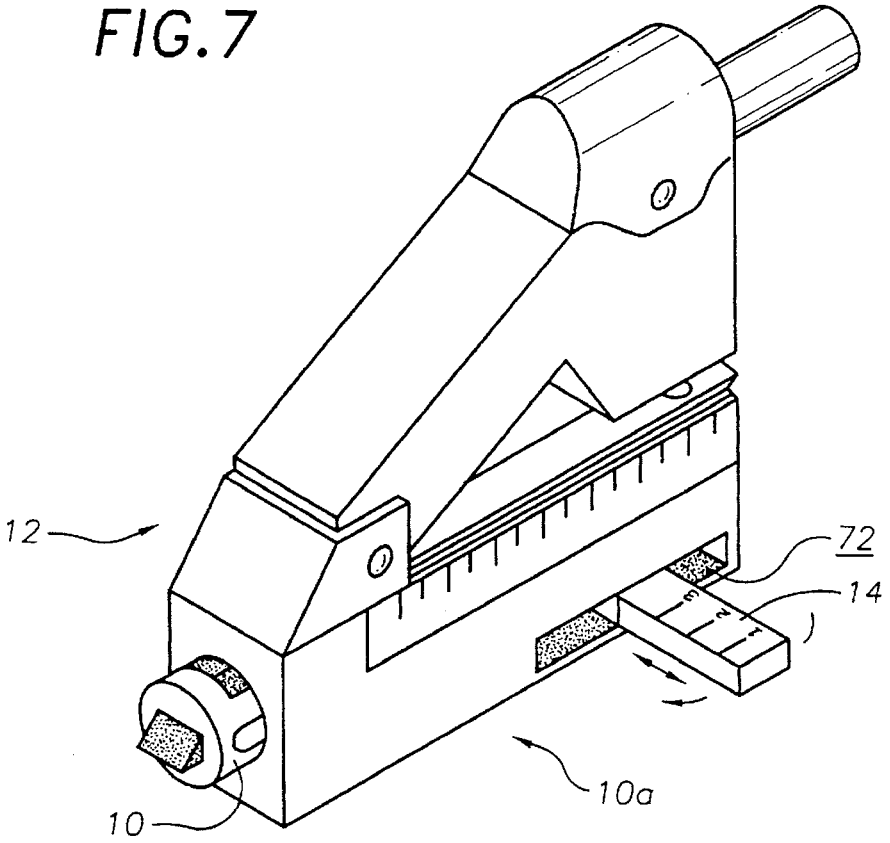
FIG. 7 is a perspective view of a second exemplary embodiment of the punching/embossing tool of the present invention showing a punch/die set storage drawer and a second exemplary desk top type pressing mechanism.

FIG. 7 shows a second exemplary embodiment of the punching/embossing tool, generally designated by the numeral 10*a*. In this embodiment a punch/die set storage drawer 70 is provided at the rear of a desk top pressing mechanism 12. Also shown in this embodiment is a swing out ruler 14 that is pivotally mounted within a ruler storage cavity 72.

It can be seen from the preceding description that a hand operated punching/embossing tool has been provided that has a punch/die set that can be oriented in a variety of user selectable directions with respect to the hand operated punching/embossing tool; and that includes a gauge mechanism for allowing a user to gauge the position of the design to be embossed or punched out with respect to an edge of the sheet material.

It is noted that the embodiment of the punching/embossing tool for sheet materials described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A punching/embossing tool for sheet materials comprising:

at least one matched punch/die set including:

a punch member and a die member, each punch member having:

a punch base constructed from a metal that is magnetically attractable and that is formed into an octagonal cylinder having eight planar punch base sidewalls and being of a first diameter, a first slot insertion member having an octagonal cylinder shape having eight planar first slot insertion member sidewalls and being of a second diameter less than said first diameter, said slot insertion member being coaxially aligned with and secured to said punch base at a first end of said first slot insertion member, and a punch protrusion extending from a second end of said slot insertion member, each die member having:

a die base constructed from a metal that is magnetically attractable and that is formed into an octagon cylinder having eight planar die base sidewalls and being of a third diameter, a second slot insertion member having an octagonal cylinder shape having eight planar second slot insertion member sidewalls and being of a fourth diameter less than said third diameter, said second slot insertion member being coaxially aligned with and secured to said die base at a third end of said second slot insertion member, and a die cavity extending into a fourth end of said slot insertion member that corresponds to said punch protrusion in a manner such that said punch protrusion is mateable with said die cavity; and a pressing mechanism including first and second pivotally connected compression members, said first compression member including a punch receiving cavity accessible through a punch opening formed within a first outer housing, said first outer housing having a first receiving slot formed therein that is open at a first housing end thereof to said punch opening and having a width to engageably receive therein said first slot member, and a first retaining magnet having at least four planar first magnetic surfaces oriented with respect to each other in a manner to allow four of said eight planar punch base sidewalls to be placed in sidewise contact with said at least four planar first magnetic surfaces, said first retaining magnet being disposed within said punch receiving cavity in a manner to allow said first slot insertion member to be disposed within said first receiving slot while four of said eight planar punch base sidewalls are in sidewise contact with said at least four planar first magnetic surfaces, said second compression member including a die receiving cavity accessible through a die opening formed within a second outer housing, said second outer housing having a second receiving slot that is open at a second housing end thereof to said die opening and having a width to engageably receive therein said second slot member, and a second retaining magnet having at least four planar second magnetic surfaces oriented with respect to each other in a manner to allow four of said eight planar die base sidewalls to be placed in sidewise contact with said at least four planar second magnetic surfaces, said second retaining magnet being disposed within said die receiving cavity in a manner to allow said second slot insertion member to be disposed within said second receiving slot while four of said eight planar die base sidewalls are in sidewise contact with said at least four planar second magnetic surfaces;

said first and second receiving slots being position in a manner such that said punch protrusion and said die cavity are mated when said first and second compression members are pivoted into a first position, said first slot insertion member is disposed within said first receiving slot while four of said eight planar punch base sidewalls are in sidewise contact with said at least four planar first magnetic surfaces, and said second slot insertion member is disposed within said second receiving slot while four of said eight planar die base sidewalls are in sidewise contact with said at least four planar second magnetic surfaces.

2. The punching/embossing tool for sheet materials of claim 1, wherein:

one of said first and second compression members includes a swing out gauging mechanism.

3. The punching/embossing tool for sheet materials of claim 2 wherein:

said pressing mechanism includes a drawer having dimensions sufficient to store therein a plurality of said punch/die sets.

4. The punching/embossing tool for sheet materials of claim 2 wherein:

said punch base, said first slot member and said punch protrusion are integrally formed.

5. The punching/embossing tool for sheet materials of claim 4 wherein:

said pressing mechanism includes a drawer having dimensions sufficient to store therein a plurality of said punch/die sets.

6. The punching/embossing tool for sheet materials of claim 2, wherein:

said one of said first and second compression members further includes a second gauging member in connection with said one first and second compression members having said swing out gauge mechanism, said second gauging member being oriented with respect to said swing out gauge mechanism in a manner such that said swing out gauge mechanism my be swung to a position at a right angle with respect to said second gauging member.

7. The punching/embossing tool for sheet materials of claim 6 wherein:

said pressing mechanism includes a drawer having dimensions sufficient to store therein a plurality of said punch/die sets.

8. The punching/embossing tool for sheet materials of claim 6 wherein:

said punch base, said first slot member and said punch protrusion are integrally formed.

9. The punching/embossing tool for sheet materials of claim 8 wherein:

said pressing mechanism includes a drawer having dimensions sufficient to store therein a plurality of said punch/die sets.

10. The punching/embossing tool for sheet materials of claim 1 wherein:

said punch base, said first slot member and said punch protrusion are integrally formed.

11. The punching/embossing tool for sheet materials of claim 10 wherein:

said pressing mechanism includes a drawer having dimensions sufficient to store therein a plurality of said punch/die sets.

12. The punching/embossing tool for sheet materials of claim 1 wherein:

said pressing mechanism includes a drawer having dimensions sufficient to store therein a plurality of said punch/die sets.

* * * * *